US007617621B1

(12) United States Patent
Schwede

(10) Patent No.: US 7,617,621 B1
(45) Date of Patent: Nov. 17, 2009

(54) TRENCHING CHAIN TOOTH AND METHOD FOR CUTTING INTO A BODY OF ICE USING SAME

(76) Inventor: Dieter Schwede, Box 17, Group 214, RR#2, Selkirk (CA) R1A 2A7

( * ) Notice: Subject to any disclaimer, the term of this patent is extended or adjusted under 35 U.S.C. 154(b) by 0 days.

(21) Appl. No.: 12/184,581

(22) Filed: Aug. 1, 2008

(51) Int. Cl.
*E02F 3/14* (2006.01)

(52) U.S. Cl. ..... 37/465

(58) Field of Classification Search ..... 37/347, 37/352, 353, 357, 359, 360, 450, 452, 455, 37/465; 299/84.1, 34.01, 34.04, 82.1, 83.1; 83/830, 831, 833, 834
See application file for complete search history.

(56) References Cited

U.S. PATENT DOCUMENTS 1,745,090 A * 1/1930 Geithle ..... 37/465
1,886,382 A * 11/1932 Dunlap ..... 37/465
2,589,914 A * 3/1952 Wolf ..... 30/384
2,946,142 A * 7/1960 Swanson ..... 37/347
4,651,449 A * 3/1987 Rose ..... 37/465
6,085,448 A * 7/2000 Gale et al. ..... 37/458
6,854,201 B1 2/2005 Hunter et al.

OTHER PUBLICATIONS

Robert B. Haehnel, Nonstructural Ice Control, Dec. 1998, US Army Corps of Engineers Cold Regions Research & Engineering Laboratory, U.S.A.

* cited by examiner

*Primary Examiner*—Robert E Pezzuto
(74) *Attorney, Agent, or Firm*—Ade & Company Inc.; Kyle R. Satterthwaite; Ryan W. Dupuis

(57) ABSTRACT

A trenching chain tooth for cutting ice features a support portion projecting laterally from a mounting portion. A first cutting portion projects to a side of the support portion opposite the mounting portion. A second cutting portion projects laterally from the first cutting portion to the same side as the support portion at a distance therefrom. Each cutting portion features a cutting edge near a leading end of the supporting portion. The cutting edge of the second cutting portion extends obliquely away from that of the first cutting portion toward a trailing end of the supporting portion. Each cutting portion feature stainless steel and, in direction extending away from its respective cutting edge, extends toward the mounting portion. A chain trencher equipped with teeth of this type is positioned a over a body of ice and operated to cut into the body of ice with the trenching teeth from thereabove.

16 Claims, 6 Drawing Sheets

TRENCHING CHAIN TOOTH AND METHOD FOR CUTTING INTO A BODY OF ICE USING SAME

FIELD OF THE INVENTION

This invention relates generally to ice cutting teeth for a chain trencher.

BACKGROUND OF THE INVENTION

Several different approaches for weakening, breaking or removing ice cover on a river have been tested or adopted in the field of ice jam reduction and prevention. One such approach is the use of mechanical cutting machines to cut lines or patterns into the surface ice on a frozen-over river to encourage the large body of surface ice to break up into smaller pieces than would otherwise naturally occur during spring breakup.

Chain type trenching machines, conventionally designed and used to dig trenches or ditches in the earth for laying and subsequent burying of cable or pipe, come in varying sizes and styles including small walk-behind units, self-propelled ride-on units and attachment units designed for mounting on existing work machines for operation by the power take-off systems thereof. These machines each feature a swingable boom having a tooth or blade equipped chain extended around its periphery and entrained about drive and idler sprockets at opposite ends of the boom so that the chain and the teeth or blades projecting outward therefrom are driven about the boom. The boom is pivotal about its drive end so that the opposite distal end can be lowered and raised into and out of engagement with a surface on which the machine is supported to facilitate cutting or digging thereinto.

It is known to use a chain trencher to cut partially through the ice surface of a frozen-over river at a time sufficiently in advance of the expected breakup period to allow safe use of the trenching machinery atop the frozen surface of the river while promoting the creation of smaller ice pieces when breakup occurs so as to reduce the likelihood of an ice jam. However, as trenchers are conventionally designed for use as earth digging machines intended for use in soil and other ground materials, the performance of conventional trenching teeth in ice cutting applications may leave room for improvement.

Therefore, there is a desire for a trenching tooth improved for use in an ice-cutting context.

SUMMARY OF THE INVENTION

According to a first aspect of the invention there is provided a trenching chain tooth comprising:

a mounting portion arranged for attachment to the trenching chain;

a support portion projecting laterally from the mounting portion to one side thereof;

a first cutting portion projecting to a side of the support portion opposite the mounting portion along a distal edge of the support portion opposite the mounting portion; and a second cutting portion projecting laterally from the first cutting portion to a same side thereof as the support portion along an edge of the first cutting portion opposite the support portion so as to project over the support portion at a distance therefrom;

respective cutting edges being defined at leading edges of the first and second cutting portions nearest a leading end of the supporting portion, the respective cutting edge of the second cutting portion extending obliquely away from the respective cutting edge of the first cutting portion toward a trailing end of the supporting portion opposite the leading end thereof.

Preferably the cutting portions comprise stainless steel.

Preferably the first cutting portion, in a direction extending away from the respective cutting edge thereof, extends toward the mounting portion.

Preferably the second cutting portion, in a direction extending away from the respective cutting edge thereof, extends toward the supporting portion.

Preferably each cutting portion comprises a generally planar plate-like body.

According to a second aspect of the invention there is provided a trenching chain tooth comprising:

a mounting portion arranged for attachment to the trenching chain;

a support portion projecting laterally from the mounting portion to one side thereof;

a first cutting portion projecting to a side of the support portion opposite the mounting portion along a distal edge of the support portion opposite the mounting portion; and a second cutting portion projecting laterally from the first cutting portion to a same side thereof as the support portion along an edge of the first cutting portion opposite the support portion so as to project over the support portion at a distance therefrom;

respective cutting edges being defined at leading edges of the first and second cutting portions nearest a leading end of the supporting portion; and at least one of the cutting portions, in a respective direction extending away from the respective cutting edge thereof, extending toward the mounting portion.

Preferably each of the cutting portions, in the respective direction extending away from the respective cutting edge thereof, extends toward the mounting portion.

According to a third aspect of the invention there is provided a trenching chain tooth comprising:

a mounting portion arranged for attachment to the trenching chain; and a cutting portion carried on the mounting portion and having a cutting edge defined at a leading edge of the cutting portion nearest a leading end of the mounting portion;

the cutting portion comprising stainless steel.

Preferably the cutting portion comprises a generally planar plate-like stainless steel body.

The mounting portion and the cutting portion may comprise two interconnected bodies of different materials than one another. In this instance, the mounting body may comprise non-stainless steel, that is, a steel other than stainless steel.

According to a fourth aspect of the invention there is provided a method of cutting into a body of ice, the method comprising:

positioning a chain trencher equipped with trenching teeth according to any one of the first three aspects of the invention over the body of ice; and operating the chain trencher to cut into the body of ice with the trenching teeth from thereabove.

Preferably the body of ice comprises surface ice of a river, the method comprising reducing a risk of ice jam formation on the river by cutting into the surface ice to promote breaking-up thereof.

BRIEF DESCRIPTION OF THE DRAWINGS

In the accompanying drawings, which illustrate an exemplary embodiment of the present invention.

DETAILED DESCRIPTION

Figure 1:
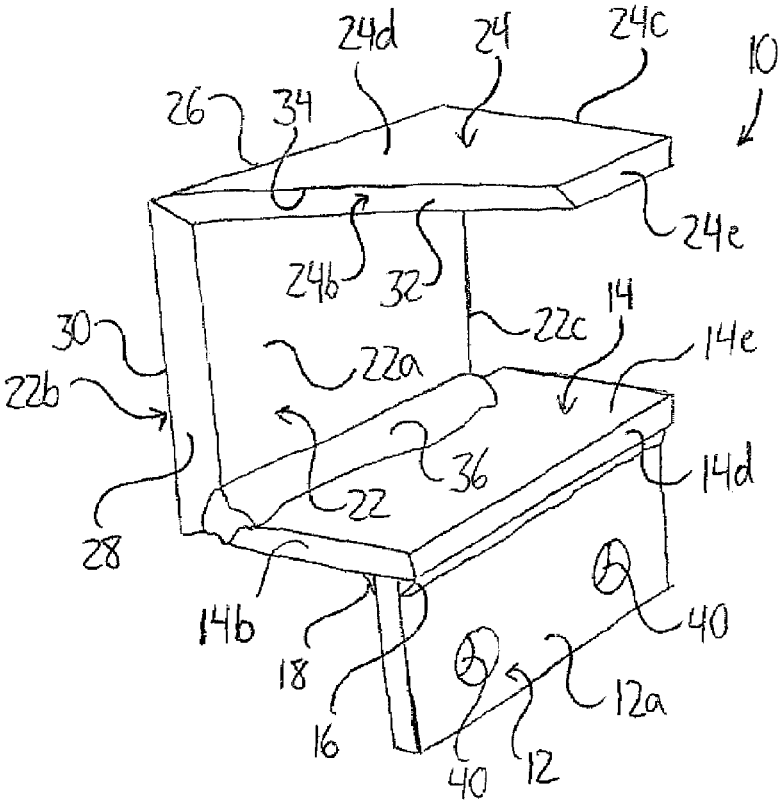
FIG. 1 is a perspective view of a trenching chain tooth according to the present invention.
Figure 2:
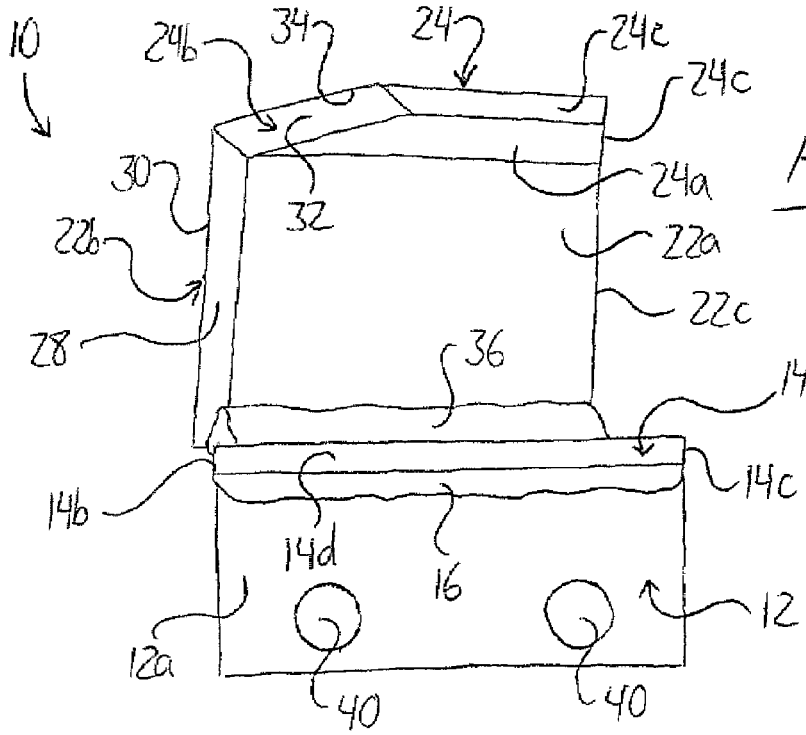
FIG. 2 is a side elevational view of the trenching chain tooth from an inner side thereof.
Figure 3:
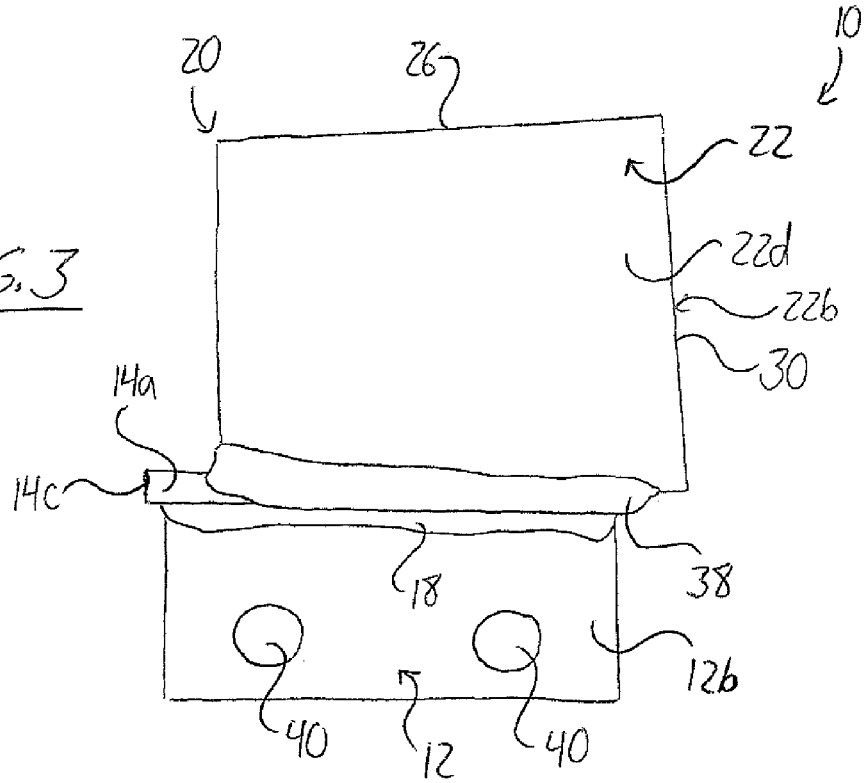
FIG. 3 is an opposite side elevational view of the trenching chain tooth from an outer side thereof.
Figure 4:
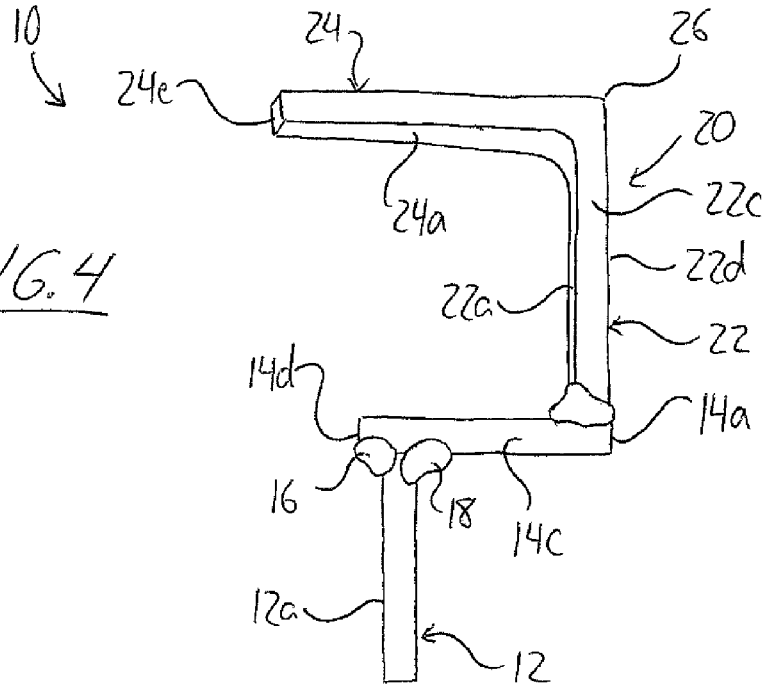
FIG. 4 is a trailing end view of the trenching chain tooth.
Figure 5:
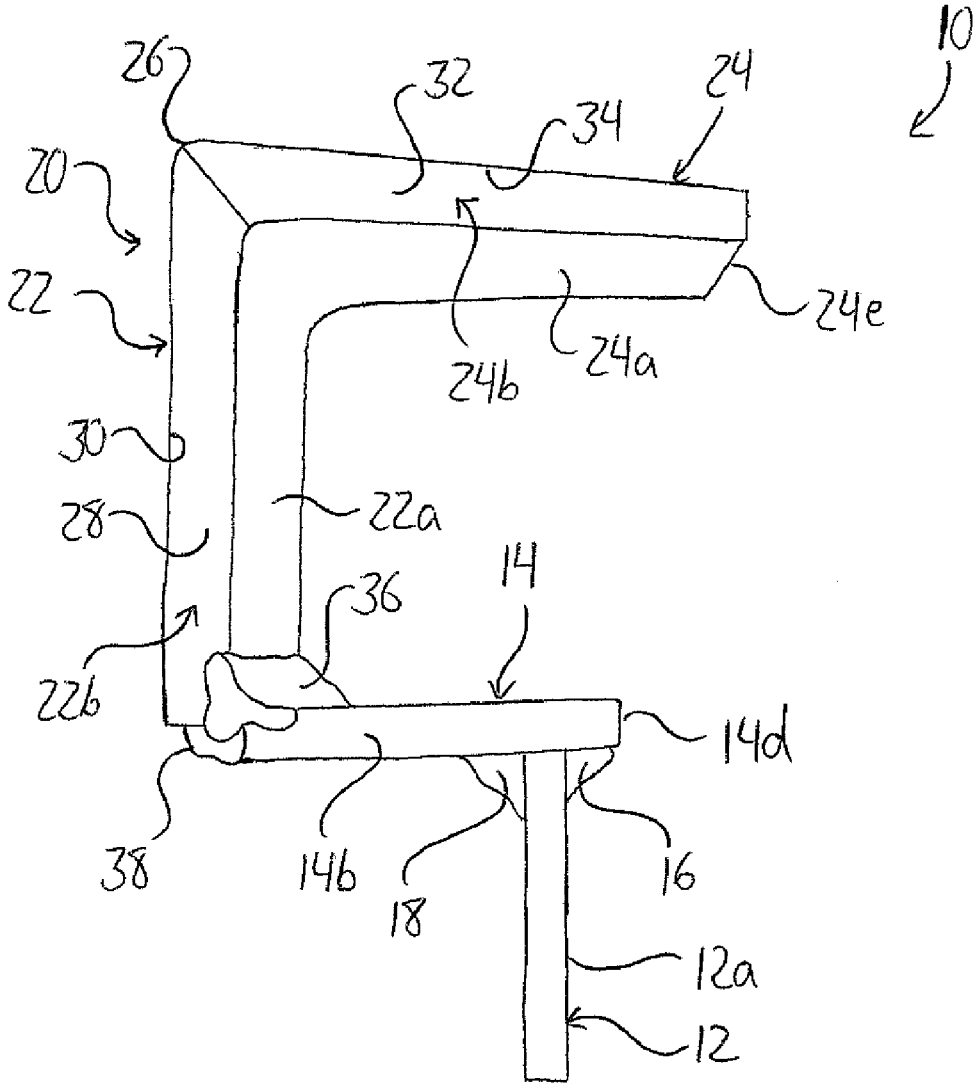
FIG. 5 is a leading end view of the trenching chain tooth.
Figure 6:
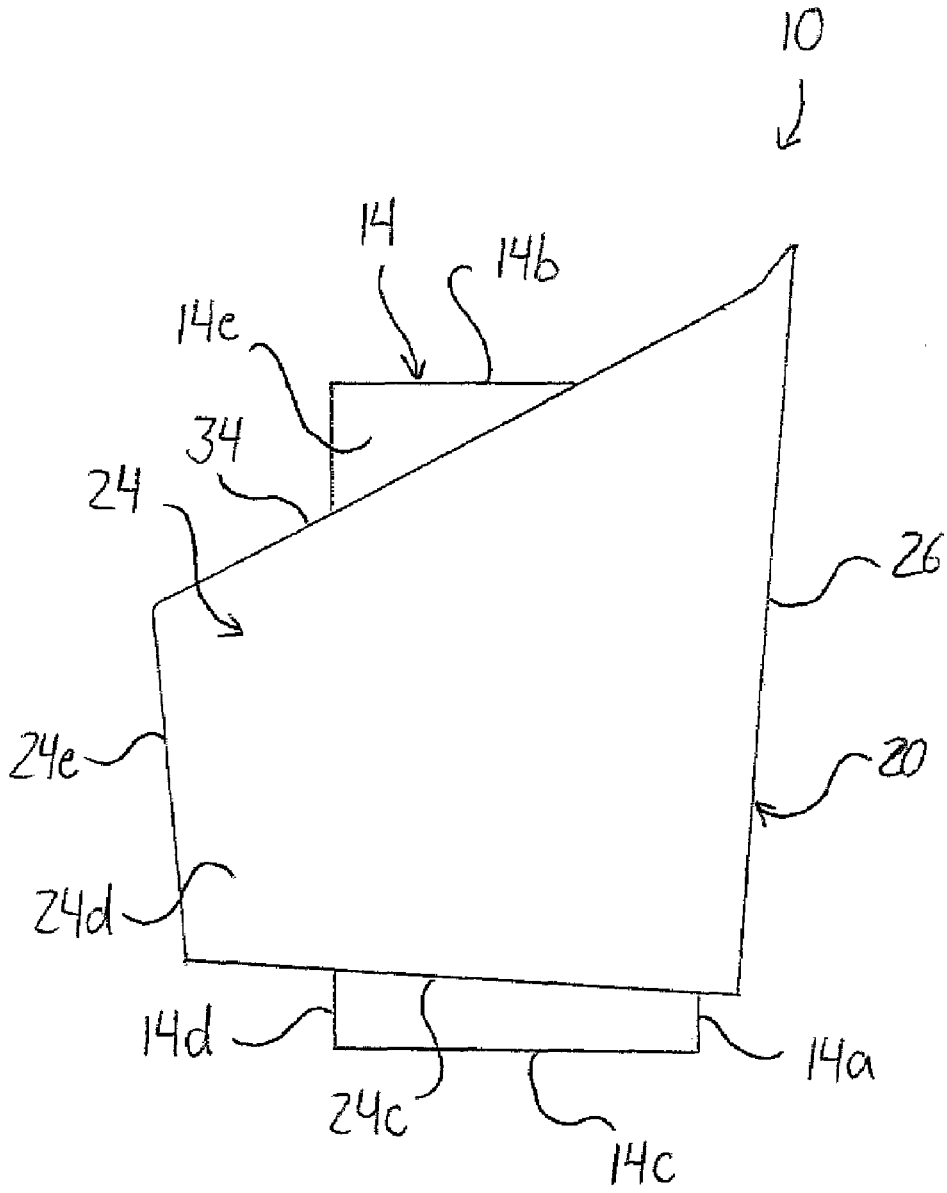
FIG. 6 is an overhead plan view of the trenching chain tooth.

With reference to the accompanying figures, the chain trencher tooth 10 of the preferred embodiment features a rectangular steel mounting plate 12 elongated in one of the two planar dimensions defined by its rectangular faces bounded by the plate's thickness-defining edges. An elongate rectangular supporting plate 14 situated at one of the mounting plate's two longer sides lies in a plane normal to that of the mounting plate 12 so as to project laterally and perpendicularly from the mounting plate 12. The supporting plate 14 projects further from the mounting plate 12 on one side thereof than on an opposite thereof defining a mounting face 12*a*. The mounting plate 12 and supporting plate 14 are equal in length and arranged with their respective central longitudinal axes parallel to one another. On the mounting face side of the mounting plate 12, the supporting plate 14 projects therefrom only far enough to accommodate a tee fillet weld bead 16 extending the common length of the longitudinally aligned plates 12, 14 between the mounting face 12*a* of the mounting plate 12 an the face of the supporting plate 14 resting flush against the respective one of the two longer edges of the mounting plate 12. On the other side of the mounting plate 12, a second matching tee fillet bead 18 similarly joins the same face of the supporting plate 14 with the opposite face 12*b* of the mounting plate 12, but the supporting plate 14 projects from the mounting plate 12 beyond this second tee fillet bead 18.

Along a distal edge 14*a* of the supporting plate, defined by the one of the two longer edges of the supporting plate 14 that is furthest from the mounting plate 12, a right-angle cutting member 20 is fixed to the supporting plate 14. A first generally plate-like leg 22 of the cutting member 20 projects from the supporting plate 14 to a side thereof opposite the mounting plate 12 in a plane normal to that of the mounting plate 14 to support a second leg 24 of the right-angle cutting member 20 at an end of the first leg 22 opposite the supporting plate 14. The right-angle cutting member 20 is oriented such that the second leg 24 projects perpendicularly from the first leg 22 to the same side thereof as the supporting plate 14. Inner faces 20*a*, 22*a* of the first and second legs of the right-angle cutting member 20 face toward, but are not parallel to, the planes of the mounting plate 12 and supporting plate 14 respectively. The plate-like first leg 22 extending along the distal edge 14*a* of the supporting plate is not parallel thereto, instead obliquely angling slightly toward the plane of the mounting plate 12 from a leading end 22*b* of first leg 22 to a trailing end 22*c* thereof. The right-angle corner edge 26 formed between the two legs 22, 24 not only angles toward the plane of the mounting plate 12 in this manner with the first leg 22, but also obliquely angles slightly toward the plane of the supporting plate 14 with the second leg 24 from a leading end 24*b* of the second leg 24 to a trailing end 24*c* thereof.

The first leg 22 uniformly tapers in thickness toward its leading end 22*b* over a fractional portion of its length, which is measured from its leading end 22*b* to its trailing end 22*c* parallel to the corner edge 26. As shown in the figures, this creates a first uniform bevel 28 connecting the inner face 22*a* of the first leg 22 with an opposite outer face 22*d* of the first leg facing away from the plane of the mounting plate 12, the intersection of the bevel 28 and outer face 22*d* of the first leg thus defining a sharp linear first cutting edge 30. Between its connections to the second leg 24 and the mounting plate 14 and between its bevel 28 and its trailing end 22*c*, the first leg 22 is of uniform thickness, thus having a generally plate-like structure. Like the first leg 22, the second leg features a second uniform bevel 32 interconnecting its inner face 24*a* with an opposite outer face 24*d* at its leading end 24*b* such that the intersection of the second bevel 30 and outer face 22*d* of the second leg define a sharp linear second cutting edge 34. Between its connections to the first leg 22 and the mounting plate 14 and between its bevel 32 and its trailing end 24*c*, the second leg 24 is of uniform thickness, thus having a generally plate-like structure.

Unlike the first leg 22 of the right-angle cutting member 20, which has its cutting edge 30 parallel to its trailing end 22*c*, the cutting edge 34 of the second leg 24 is obliquely angled relative to its trailing end 24*c* so that this second cutting edge 34 angles obliquely away from the first cutting edge 30 toward the trailing end 24*c* of the second leg 24. The first leg 22 of the right-angle cutting member 20 is fixed to the supporting plate 14 to position the entire first cutting edge 30 outward past a leading end 14*b* of the mounting plate 14 along the longitudinal dimension thereof. The first cutting edge 30 and the corner edge 26 between the legs 22, 24 are generally perpendicular in the plane of the first leg's outer face 22*d*. As the generally plate-like second leg 24 has a slight oblique slope toward the supporting plate 14 in a direction moving away from its cutting edge along the longitudinal dimension of the supporting plate 14, this perpendicularity of the first cutting edge 30 and corner edge 26 in the plane of the outer face 22*d* of the first leg means that the first cutting edge 30 has a slight oblique slope toward a trailing end 14*c* of the supporting plate 14 opposite the leading end 14*b* thereof as the cutting edge extends toward the second leg 24 of the right-angle cutting member 20.

A distal edge 24*e* of the second leg 24 opposite the first leg 22 connects the leading and trailing ends 24*b*, 24*c* of the second leg 24 and obliquely slopes toward the first leg 22 as it extends away from the second cutting edge 34. The second leg 24 of the right-angle cutting member 20 projects sufficiently far from the first leg 22 thereof to a position the entire distal edge 24*e* of the second leg 24 on a side of the mounting plate 12 opposite the first leg 22 at a distance further from the mounting plate than the inner edge 14*d* of the supporting plate along which weld bead 16 extends. The trailing ends 22*c*, 24*c* of the first and second legs 22, 24 of the right-angle cutting member 20 are coplanar and situated between the leading and trailing ends 14*b*, 14*c* of the supporting plate 14.

The right-angle cutting member 20 is a stainless steel piece welded to the supporting body by welding beads 36, 38 extending along the first leg 22 away from its first cutting edge 30 toward its trailing end 22*c* on both sides of the generally plate-like first leg 22, bead 36 joining the inner face 22*a* of the first leg 22 to the face of the supporting plate 14 opposite the mounting plate 12 and bead 38 joining an edge of the first leg 22 extending between the leading and trailing ends 22*b*, 22*c* at a position opposite the second leg 24 to the distal edge 14*a* of the mounting plate. The integral first and second legs 22, 24 of the cutting member 20 thus define stainless steel cutting portions featuring stainless steel cutting edges. It will be appreciated that the first and second legs need not necessarily be formed by a single integral member, and for example may alternatively be formed by two interconnected pieces.

The mounting plate 12 is of a typical structure commonly used in trenching teeth, featuring a pair of spaced apart circular holes 40 therethrough to align with corresponding hole pairings in the mounting links of a trencher chain to accommodate bolts for clamping the planar mounting face 12*a* of the mounting plate 12 flush against the corresponding planar face of the plate-structured mounting link of the chain when fitted with nuts. Prototypes of the illustrated tooth have been produced with mild steel mounting and supporting plates 12, 14. It will be appreciated that the mounting plate and supporting plate need not necessarily be interconnected by welding. For example, these two plate-like members may instead be formed by a single integral right angle member of L-shaped cross section having two legs projecting perpendicularly form one another, much like the right angle cutting member of the illustrated embodiment.

In the illustrated embodiment, the first and second cutting portions 22, 24 are angled at approximately five degrees relative to the planes of the mounting and supporting plates toward which they respectively slope. Measured in the plane of the inner face 14*e* of the supporting plate 14 facing the second cutting portion 24, the outer face 22*d* of the first cutting portion is oriented at an angle of approximately five degrees to the distal edge 14*a* of the supporting plate 14, this distal edge 14*a* being parallel to the plane of the mounting plate 12. Measured in the plane of the mounting plate 12, the inner face 24*a* of the second cutting portion 24 facing the supporting plate 14 is oriented at an angle of approximately five degrees to the inner face 14*e* of the supporting plate. It will be appreciated that these angles are presented in an exemplary context and may be varied. For example, these angles may be increased to provide a tooth with a more aggressive cut or decreased to provide a less aggressive cut, as these angles determine the angles at which the cutting edges engage the ice relative to the tooth's direction of motion along the cutting chain. For example, use of a more powerful trenching machine should facilitate the use of a tooth of greater cutting angles. In the plane of the outer face 24*d* of the second cutting portion 24, the second cutting edge 34 of the illustrated embodiment is oriented at an angle of approximately sixty degrees relative to the corner edge 26 and the distal edge 24*e* of the second cutting portion 24 is oriented at approximately ten degrees relative to the corner edge 26. Again these angles are presented in an exemplary context and may be varied.

Figure 7:
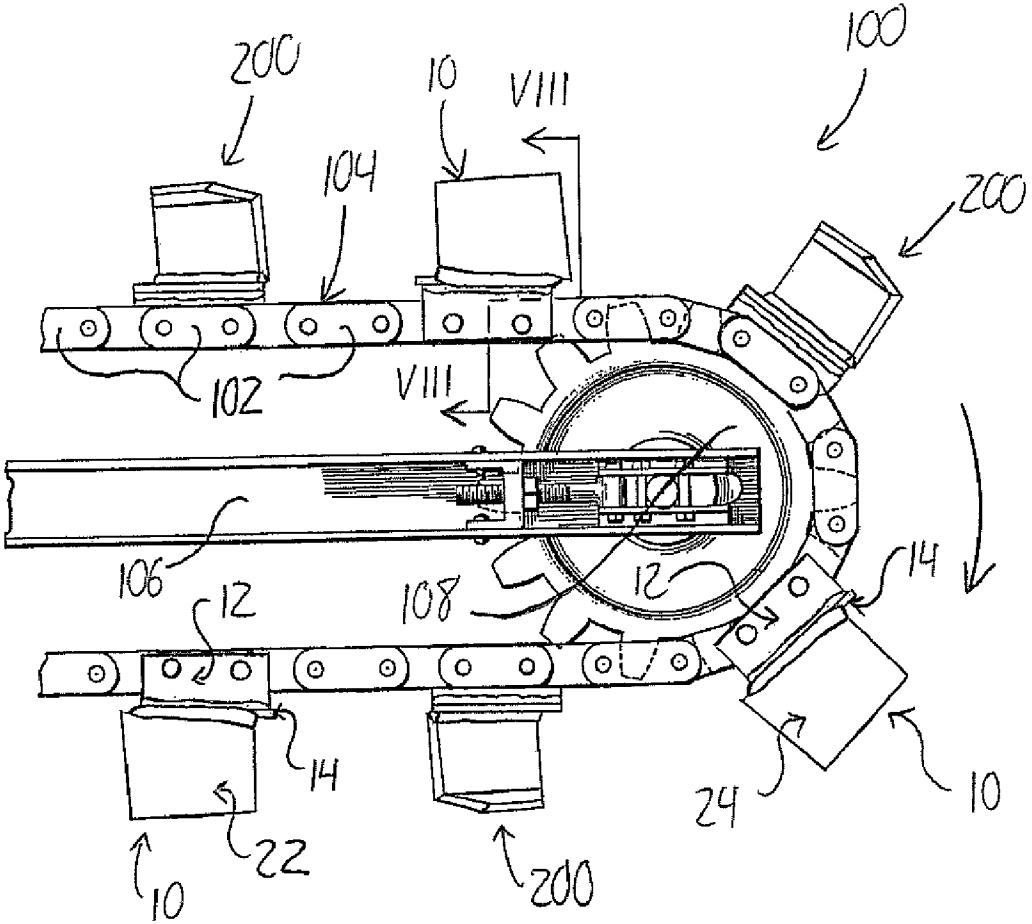
FIG. 7 is a partial side elevational view of a trencher boom equipped with trenching chain teeth according to the present invention.
Figure 8:
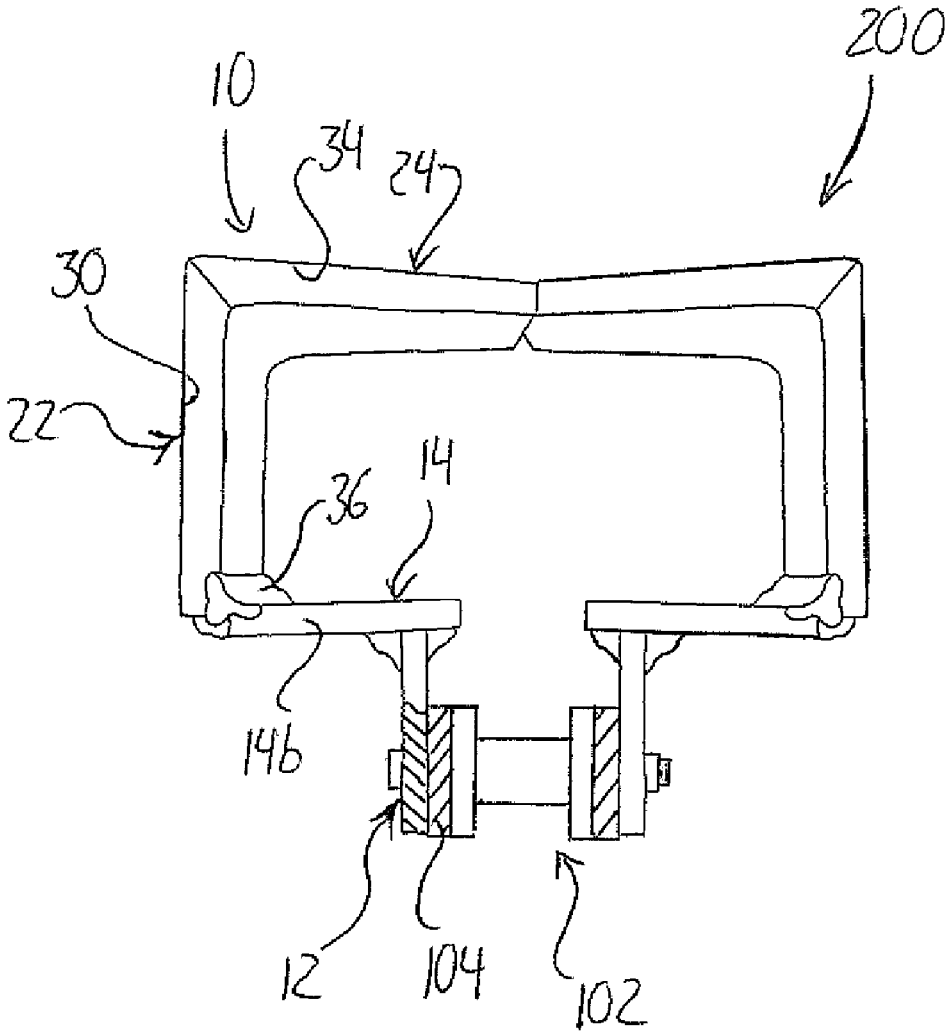
FIG. 8 is a cross-section view of the trencher boom of FIG. 7 as taken along line VIII-VIII thereof.

In use, a plurality of teeth of the type described above are bolted or otherwise fastened onto the mounting links of the chain of a chain trenching machine. FIGS. 7 and 8 illustrate such installation on the boom 100 of a chain type trencher. The mounting plate 12 of each tooth 10 is parallel to the respective one of the mounting links 102 and flush against the outer surface thereof facing laterally outward from the chain 104. The supporting plate 14 of each tooth 10 projects laterally outward away from the chain to a respective side of the boom arm 106 carrying the idler sprocket 108 about which the chain is entrained, with the second leg or cutting portion 24 of the tooth 10 projecting back over the supporting plate 14 to a position over the chain 104 outside the endless loop defined thereby. During linear portions of the chain's travel about the chain trencher's boom, the tooth travels along a linear axis parallel to the longitudinal axes of the rectangular mounting and supporting plates 12, 14 with the leading ends and cutting edges leading the rest of the tooth in the direction of chain movement. In a known arrangement, the teeth 10 installed on one side of the chain each have the structure illustrated in FIGS. 1 to 5, while teeth 200 on the other side of the chain are mirror images of those on the first side.

In the embodiment of FIG. 8, teeth on opposite sides of the chain alternate along the endless loop chain so that one tooth is on one side and the next tooth along the chain is on the opposite side. The second cutting portion of each tooth extends past the vertical mid-plane of the trencher boom 100 and chain 102 from the respective side thereof so that the teeth on opposite sides of the chain perform overlapping cuts. In the illustrated embodiment, the teeth are installed on every other pair of aligned outer links, that is, there are two inner link pairings and one outer link pairing disposed between every pair of adjacent left and right hand teeth. It will be appreciated that the teeth on the chain may alternatively be installed with the mounting plates thereof inside the chain, that is, with the mounting plates each mounted on the side of a respective link of the chain facing the vertical mid-plane of the trencher boom 100. This allows for the cutting width of a trencher to be changed using the same chain and same teeth, as the same teeth instead installed at the inner faces of the chain links will not project as far laterally outward from the chain as shown in the outside mounting arrangement of FIGS. 7 and 8. The spacing of teeth along the chain may also be varied, for example with a tooth mounted on one side of every outer link pairing, or with more empty links disposed between each two adjacent teeth than in the illustrated embodiment.

To cut through the surface ice of a river, the trenching machine having the ice cutting teeth described herein installed thereon is maneuvered out onto the ice and the machine is operated in its typical manner to drive rotation of the trenching chain about the boom arm of the machine, moving away from the machine-carried drive end of the boom arm along the top thereof, curving around the idler sprocket at the opposite free distal end of the boom and back again along the bottom of the boom arm. With the chain still being driven, the boom is subsequently pivoted downward about its machine-carried drive end to lower its free distal end into engagement with the ice to cut thereinto. Different patterns or arrangements of cutting lines for weakening surface ice to promote breakage into smaller pieces during spring break-up are known, and thus not detailed herein. The teeth may be used on self-propelled, ride-on, walk-behind or attachment type trenching machines. It will be appreciated that the teeth may similarly be used to cut into bodies of ice other than surface ice of a river.

The prototype teeth have been used to cut river ice and have been found to provide significant improvement in ice cutting performance relative to conventional trenching teeth intended for use in earth digging, cutting, trenching, or ditching applications. In the context of ice cutting, where the teeth are likely exposed to higher levels of moisture relative to most earth trenching applications, the stainless steel cutting portions resist corrosion better than the mild steel with hardened cutting edges typically used to produce conventional earth-trenching teeth. The use of stainless steel to define the entire bodies that define and thus carry the cutting edges also allows for re-sharpening of the cutting edges as they dull or wear, without the need to re-hardsurface as required in conventional mild steel trenching teeth. The sloping of the first and second cutting portions 22, 24 toward the toward the mounting plate 12 (the first portion 22 sloping toward the plane of the mounting plate 12 and the second portion 24 sloping toward the plane of the supporting plate 14 with which the mounting plate 12 connects) moving away from their respective cutting edges 30, 34 toward their respective trailing ends 22*c*, 24*c* makes the tooth tapered in width and height, narrowing away from the leading end 14*b* of the supporting plate 14 to the trailing end 14*c* thereof along its central longitudinal axis, the width measured in the plane of the supporting plate 14 perpendicularly from the inner end 14*d* thereof to the first cutting portion 22 and the height measured between the facing-together inner faces 14*e*, 24*a* of the supporting plate 14 and second cutting portion 24 in a direction perpendicular to this inner face 14*e* of the supporting plate 14 in a plane parallel to the mounting plate 12. This tapering in two dimensions of the space between the supporting plate 14 and the cutting portions 22, 24 corresponds to non-zero angles of clearance between the outer faces 22*d*, 24*d* of the first and second cutting members 22, 24 and respective planes passing through the first and second cutting edges 30, 34 in the direction of the cutting motion to reduce friction. Similarly the angling of the distal edge 24*e* of the second cutting portion provides a clearance angle between this edge and a plane passing through the intersection of the second cutting portion's leading end 24*b* and distal edge 24*e* in the direction of the cutting motion.

Since various modifications can be made in my invention as herein above described, and many apparently widely different embodiments of same made within the spirit and scope of the claims without department from such spirit and scope, it is intended that all matter contained in the accompanying specification shall be interpreted as illustrative only and not in a limiting sense.

The invention claimed is:

1. A trenching chain tooth for a trenching chain, the tooth comprising:

a mounting portion arranged for attachment to the trenching chain;

a support portion projecting laterally from the mounting portion to one side thereof;

a first cutting portion projecting to a side of the support portion opposite the mounting portion along a distal edge of the support portion opposite the mounting portion; and a second cutting portion projecting laterally from the first cutting portion to a same side thereof as the support portion along an edge of the first cutting portion opposite the support portion so as to project over the support portion at a distance therefrom;

respective cutting edges being defined at leading edges of the first and second cutting portions nearest a leading end of the supporting portion, the respective cutting edge of the second cuffing portion extending obliquely away from the respective cutting edge of the first cutting portion toward a trailing end of the supporting portion opposite the leading end thereof.

2. The tooth according to claim 1 wherein the cutting portions comprise stainless steel.

3. The tooth according to claim 1 wherein the first cutting portion, in a direction extending away from the respective cutting edge thereof, extends toward the mounting portion.

4. The tooth according to claim 1 wherein the second cutting portion, in a direction extending away from the respective cutting edge thereof, extends toward the supporting portion.

5. The tooth according to claim 1 wherein each cutting portion comprises a generally planar plate-like body.

6. The tooth according to claim 1 where in the cutting portions are defined by a single stainless steel body fixed to the mounting and support portions.

7. The tooth according to claim 6 wherein the mounting and support portions comprise non-stainless steel.

8. The tooth according to claim 6 wherein the mounting and support portions comprise different material than the stainless steel body defining the cutting portions.

9. The tooth according to claim 1 wherein the cutting portions are formed entirely of stainless steel.

10. The tooth according to claim 9 wherein the mounting and support portions comprise different material than the cutting portions.

11. The tooth according to claim 9 wherein the mounting and support portions comprise non-stainless steel.

12. A trenching chain tooth for a trenching chain, the tooth comprising:

a mounting portion arranged for attachment to the trenching chain; and a cutting portion comprising a stainless steel body carried on the mounting portion, the stainless steel body having a stainless steel cutting edge defined at a leading edge thereof nearest a leading end of the mounting portion and the stainless steel body extending from the stainless steel cuffing edge toward a trailing end of the mounting portion opposite the leading end of the mounting portion.

13. The tooth according to claim 12 wherein the mounting portion comprises non-stainless steel.

14. The tooth according to claim 12 wherein the stainless steel body defines the cutting portion in entirety.

15. The tooth according to claim 12 wherein the stainless steel body is a generally planar plate-like body.

16. The tooth according to claim 12 wherein the mounting portion and the cutting portion comprise two interconnected bodies of different materials than one another.

* * * * *